US006932041B1

(12) United States Patent
Riley

(10) Patent No.: US 6,932,041 B1
(45) Date of Patent: Aug. 23, 2005

(54) APPARATUS AND METHOD FOR MAINTAINING CONTROLLED ORIENTATION OF A ROLLER LIFTER FOLLOWER USED IN CONJUNCTION WITH A VARIABLE PHASED LIFTER

(75) Inventor: Michael Bernard Riley, Fort Collins, CO (US)

(73) Assignee: Motive Engineering Co., Fort Collins, CO (US)

( * ) Notice: Subject to any disclaimer, the term of this patent is extended or adjusted under 35 U.S.C. 154(b) by 0 days.

(21) Appl. No.: 10/816,098

(22) Filed: Apr. 1, 2004

(51) Int. Cl.[7] ..... F01L 1/18
(52) U.S. Cl. ..... 123/90.44; 123/90.16; 123/90.39
(58) Field of Search ..... 123/90.39, 90.4, 123/90.42, 90.44, 90.5, 906.16, 90.27, 90.31, 123/90.48, 90.35; 74/559, 567, 569

(56) References Cited

U.S. PATENT DOCUMENTS 4,089,234 A 5/1978 Henson et al.
5,022,356 A * 6/1991 Morel et al. ..... 123/90.5
5,263,386 A 11/1993 Campbell et al.
5,546,899 A 8/1996 Sperling et al.
5,746,167 A * 5/1998 Jesel ..... 123/90.35
5,934,232 A 8/1999 Greene et al.
5,947,069 A 9/1999 Koerner
6,257,189 B1 7/2001 Moretz et al.
6,357,407 B2 3/2002 Brothers
6,736,097 B2 * 5/2004 Riley ..... 123/90.2

* cited by examiner

*Primary Examiner*—Thomas Denion
*Assistant Examiner*—Ching Chang
(74) *Attorney, Agent, or Firm*—Gibson, Dunn & Crutcher LLP; Stanley J. Gradisar

(57) ABSTRACT

In a variable phased valve lifter of an internal combustion engine, a roller lifter is allowed to move along a constraining face of a constraining mechanism in a first direction, and the constraining mechanism is allowed to move freely in a second direction. As the roller lifter moves through its arcuate path, the flat surface(s) of the roller lifter will slide across the constraining face(s) of the constraining mechanism, and end members of the constraining mechanism slide fore-and-aft in at least one stationary block. The roller lifter is thus prevented from rotating about its longitudinal axis as it moves in arcuate fashion in cooperation with the constraining mechanism.

34 Claims, 9 Drawing Sheets

APPARATUS AND METHOD FOR MAINTAINING CONTROLLED ORIENTATION OF A ROLLER LIFTER FOLLOWER USED IN CONJUNCTION WITH A VARIABLE PHASED LIFTER

CROSS REFERENCE TO RELATED APPLICATION

This application is related to a co-pending patent application Ser. No. 10/266,335 titled "APPARATUS AND METHOD FOR MAINTAINING CONTROLLED ORIENTATION OF A ROLLER LIFTER FOLLOWER USED IN CONJUNCTION WITH A VARIABLE PHASED VALVE LIFTER", and filed on Oct. 8, 2002, now allowed, which is owned by the same assignee of this invention.

FIELD OF THE INVENTION

This invention relates to an internal combustion engine using poppet type valves to direct gases into and out of one or more cylinders or cam operated fuel injection units to inject fuel into one or more cylinders. More particularly, the orientation of a roller lifter follower in a pushrod operated engine is to be kept constant during rotation of a rotatable element to alter the phasing of the valves or injectors in the engine.

BACKGROUND OF THE INVENTION

A description of a phasing system for roller lifter followers on a camshaft is given by Riley in U.S. Pat. No. 6,155,216, which is hereby incorporated by reference for all that is taught and disclosed therein.

As the rotatable element, such as an eccentric sleeve, is rotated to phase the roller lifter follower (hereinafter simply "roller lifter"), the roller lifter orientation must be controlled to allow the roller to follow the cam lobe on the camshaft. In fixed timing systems a simple pin or plate is usually sufficient to prevent the roller lifter from rotating around its longitudinal axis during operation. The arcuate path of the phased roller lifter requires an extra degree of freedom of movement. Therefore additional measures must be taken in order to maintain controlled orientation of the roller lifter.

SUMMARY OF THE INVENTION

The present invention describes a simple system for providing controlled orientation of a roller lifter in a pushrod engine using a phasing device to change the point of contact of the roller lifter on the cam. This system is applicable to single or multiple roller lifters. It also applies to roller lifters that may have curved surfaces for contacting the cam, but may not have rollers.

Roller lifters usually have either one or more flat surfaces machined into the outer body of the roller lifter. With the phasing mechanism described in U.S. Pat. No. 6,155,216, the arcuate motion of the roller lifter during phasing would result in excessive clearance at most positions if a fixed anti-rotation mechanism were attempted, and misalignment between cam and roller lifter could result. In the present invention the roller lifter is allowed to move along a constraining face of a constraining mechanism, and the constraining mechanism is allowed to move freely in a direction substantially parallel to a line perpendicular to the flat surface machined onto the roller lifter. As the roller lifter moves through its arcuate path, the flat surface(s) of the roller lifter will slide across the constraining face(s) of the constraining mechanism.

An alternative embodiment of this anti-rotation approach is to have one or more locating pins extending from the side of the lifter, perpendicular to the roller lifter longitudinal axis. These locating pins would engage slots in a constraining mechanism and the constraining mechanism would be free to move in a direction substantially perpendicular to both the longitudinal axis of the roller lifter and the axis of the locating pins.

Another alternative embodiment of this anti-rotation approach is to machine one or more slots into the body of the roller lifter parallel to the longitudinal axis of the lifter. Engaging pins may be inserted into these slots, the engaging pins being attached to a constraining mechanism that may move substantially perpendicular to the engaging pins and the longitudinal axis of the lifter.

Another alternative embodiment of this anti-rotation approach is a one-sided spring-like deformable constraining mechanism that pushes against the flat surface of a roller lifter. The constraining mechanism moves in one direction only while allowing movement of the roller lifter in the same direction as the constraining mechanism and in a direction substantially perpendicular to this direction.

DETAILED DESCRIPTION OF THE INVENTION

Figure 1:
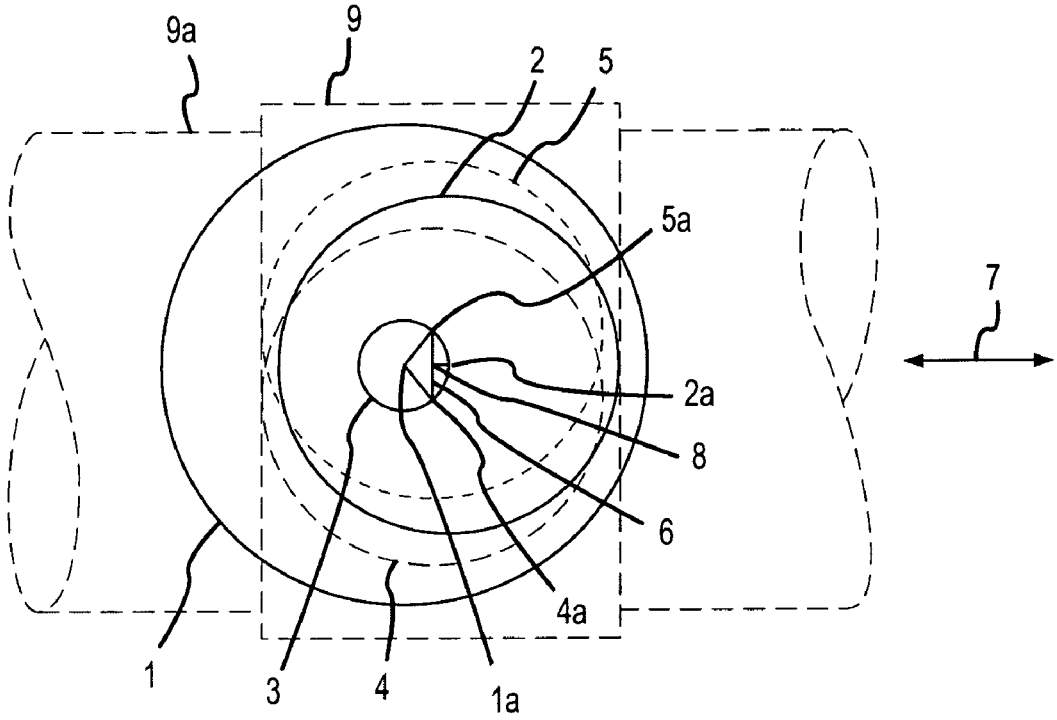
PRIOR ART FIG.1
FIG. 1 shows the prior art of how the geometry of rotation of an eccentric sleeve achieves transverse travel of a roller lifter on a cam lobe of a camshaft.

Referring now to the Figures, in which like reference numerals refer to like components thereof, FIG. 1 shows the prior art of how the geometry of rotation of an eccentric sleeve achieves transverse travel of a roller lifter on a cam lobe of a camshaft. Referring now to FIG. 1, the geometry of an eccentric sleeve, in a view from the top of the roller lifter along the longitudinal axis of the roller lifter is shown. Circle 1 is the outside edge of the eccentric sleeve, with center 1*a*, and circle 2 is the inside edge of the eccentric sleeve, with center 2*a*, offset from the center 1*a* of the eccentric sleeve. Circle 3 represents the path of the center of the offset as the eccentric sleeve is rotated. Circle 4 with center 4*a* shows the position of the offset when the eccentric sleeve is rotated by some angle, here approximately 60° clockwise, around center 1*a*. Similarly, circle 5 with center 5*a* shows the position of the offset when rotated the same amount, approximately 60°, in the opposite direction around center 1*a*. Line 6, between the centers 4*a* and 5*a* of circles 4 and 5 respectively, shows the distance that the center of the roller 11 moves transverse to the axis of the camshaft 9*a*, shown as arrow 7. Line 8, perpendicular to line 6, is the farthermost distance to circle 3. Circle 2 corresponds to the outer location of a roller lifter that would make contact with cam lobe 9. Line 8 represents the maximum fore-and-aft movement of the roller lifter along the axial direction of camshaft 9*a*, parallel to arrow 7.

Figure 2:
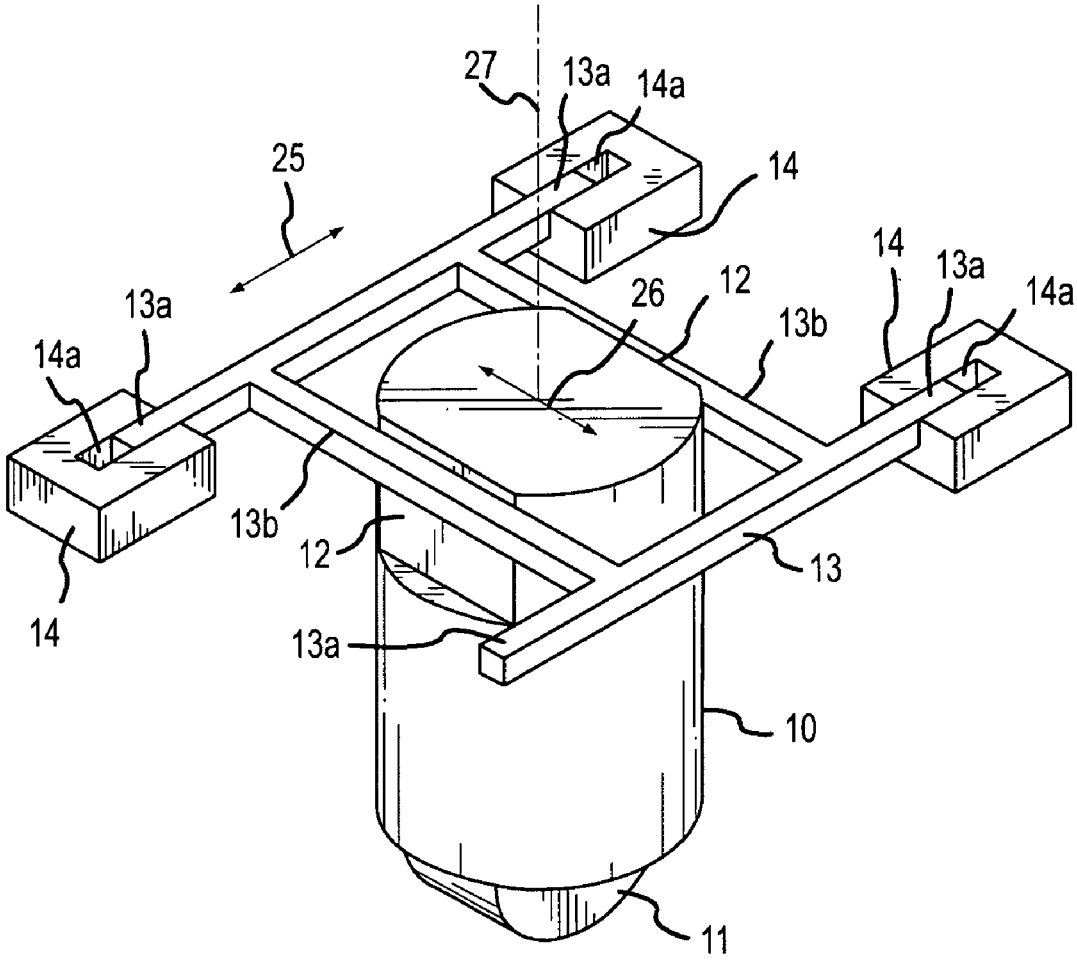
FIG. 2 shows an isometric view of one roller lifter with substantially parallel flat surfaces with one yoke-like constraining mechanism with two sides and stationary slots into which the constraining mechanism slides of the present invention.

FIG. 2 shows an isometric view of one roller lifter with substantially parallel flat surfaces with one yoke-like constraining mechanism with two sides and stationary slots into which the constraining mechanism slides of the present invention. Referring now to FIG. 2, an isometric view of a single roller lifter 10, with roller 11 and flat surfaces 12 which are substantially parallel to each other, engaged by constraining mechanism 13 is shown. Constraining mechanism 13 is constrained by one or more stationary blocks 14, which are attached to the engine in any number of ways known in the art. Stationary blocks 14 have slots 14*a* which receive end members 13*a* of constraining mechanism 13. This allows fore-and-aft movement only of constraining mechanism 13, represented by arrow 25, when actuated by movement of roller lifter 10. Roller lifter 10 may also move within the constraints of constraining mechanism 13 substantially perpendicular to arrow 25, represented by arrow 26, through the interaction of parallel flat surfaces 12 with interior members 13*b*, which are also substantially parallel to each other, of constraining mechanism 13. Allowable movement in the two substantially perpendicular directions enables the arcuate travel path of roller lifter 10 as shown in FIG. 1. Roller lifter 10 also moves axially up-and-down along its longitudinal axis 27 as it engages with the cam (not shown). Thus, one skilled in the art will recognize that roller lifter 10 is prevented from rotating about its longitudinal axis 27 as it moves in arcuate fashion in cooperation with constraining mechanism 13.

For simplicity one stationary block 14 is omitted from this view. Having all four stationary blocks 14 provides more constraint than is absolutely necessary. Only one stationary block 14 is necessary to provide a minimum amount of constraint for roller lifter 10.

Various methods may be employed to ensure that constraining mechanism 13 remains operatively engaged within slots 14*a* of stationary blocks 14 which are well known in the art. Though slots 14*a* are shown as open channels in stationary blocks 14, slots 14*a* may also be fully contained within stationary blocks 14 in a hole-like fashion. In addition, though the end members 13*a* and interior members 13*b* of constraining mechanism 13 are shown as being square or rectangular in cross section, some or all of end members 13*a* and interior members 13*b* of constraining mechanism 13 may also be round in cross section or some other shape, or a combination of round, square, rectangular, or some other shape.

One skilled in the art will recognize that interior members 13*b* that mate to flat surfaces 12 must be substantially parallel to each other. Failure to be substantially parallel would cause either wedging of the lifter, or excess slop when the lifter moved in the direction indicated by arrow 26 along interior members 13*b*. On the other hand, the directions of movement indicated by arrows 25 and 26 need not be substantially perpendicular to each other. As long as the movement of constraining mechanism 13 allows the orientation of roller lifter 10 to be maintained, perpendicularity of movement is not required. The limit to the lack of perpendicularity is that the movement of constraining mechanism 13 in the direction indicated by arrow 25 cannot be oriented too close to parallel to the direction of movement of roller lifter 10 along interior members 13*b* indicated by arrow 26 such that roller lifter 10 is constrained from moving through its eccentrically prescribed arc. A range from between 90° to about 30° between the orientation of the directions of movement indicated by arrows 25 and 26 should enable roller lifter 10 to move through its eccentrically prescribed arc without constraint while still being prevented from rotating about its longitudinal axis. An orientation below 30° may begin to impinge on the unconstrained eccentric movement of roller lifter 10, and would not be desirable.

Figure 3A:
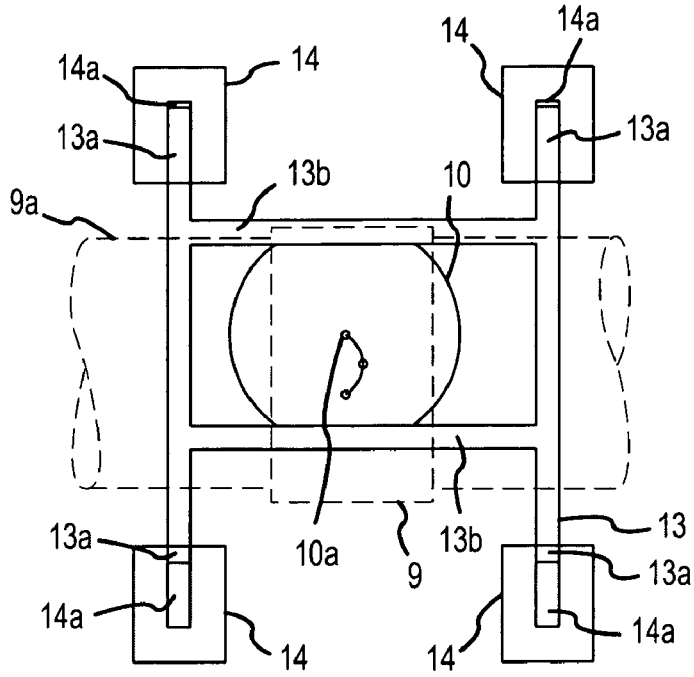
FIG. 3A shows the objects in FIG. 2 viewed from above, looking down the longitudinal axis of the roller lifter, where the roller lifter is shown in a position near one extreme of travel.

FIG. 3A shows the objects in FIG. 2 viewed from above, looking down the longitudinal axis of the roller lifter, where the roller lifter is shown in a position near one extreme of travel. Referring now to FIG. 3A, the eccentric sleeve (not shown) is rotated approximately 60° counterclockwise from a centered position, displacing roller lifter 10, whose center position is shown as center 10*a*. The center of the roller lifter 10 will follow the arc on which center 10*a* lies as the eccentric sleeve is rotated. This eccentric sleeve rotation results in phasing of the roller 11 (not shown) on cam lobe 9 differently from the centered position. Two end members 13*a* of constraining mechanism 13 have moved into slots 14*a* of stationary blocks 14 at the top of the diagram, and the other two end members 13*a* have moved out of slots 14*a* of stationary blocks 14 at the bottom of the diagram. Flat surfaces 12 on the roller lifter 10 (appearing as edges in this view) maintain the orientation of roller 11 on roller lifter 10 with cam lobe 9.

Figure 3B:
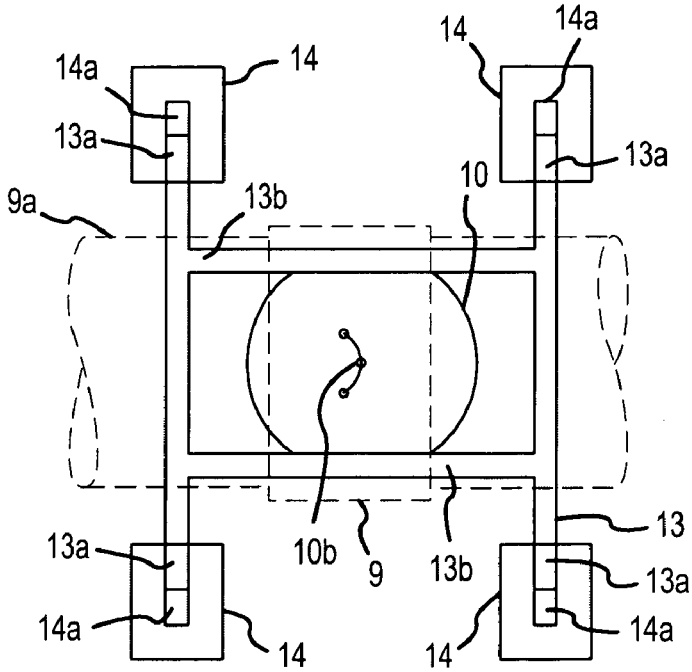
FIG. 3B shows the same view as FIG. 3A, but with the roller lifter now in a centered position.

FIG. 3B shows the same view as FIG. 3A, but with the roller lifter now in a centered position. Referring now to FIG. 3B, the eccentric sleeve (not shown) is in approximately its centered position, approximately 60° clockwise from its position in FIG. 3A. The position of the center of roller lifter 10 is center 10*b*.

Figure 3C:
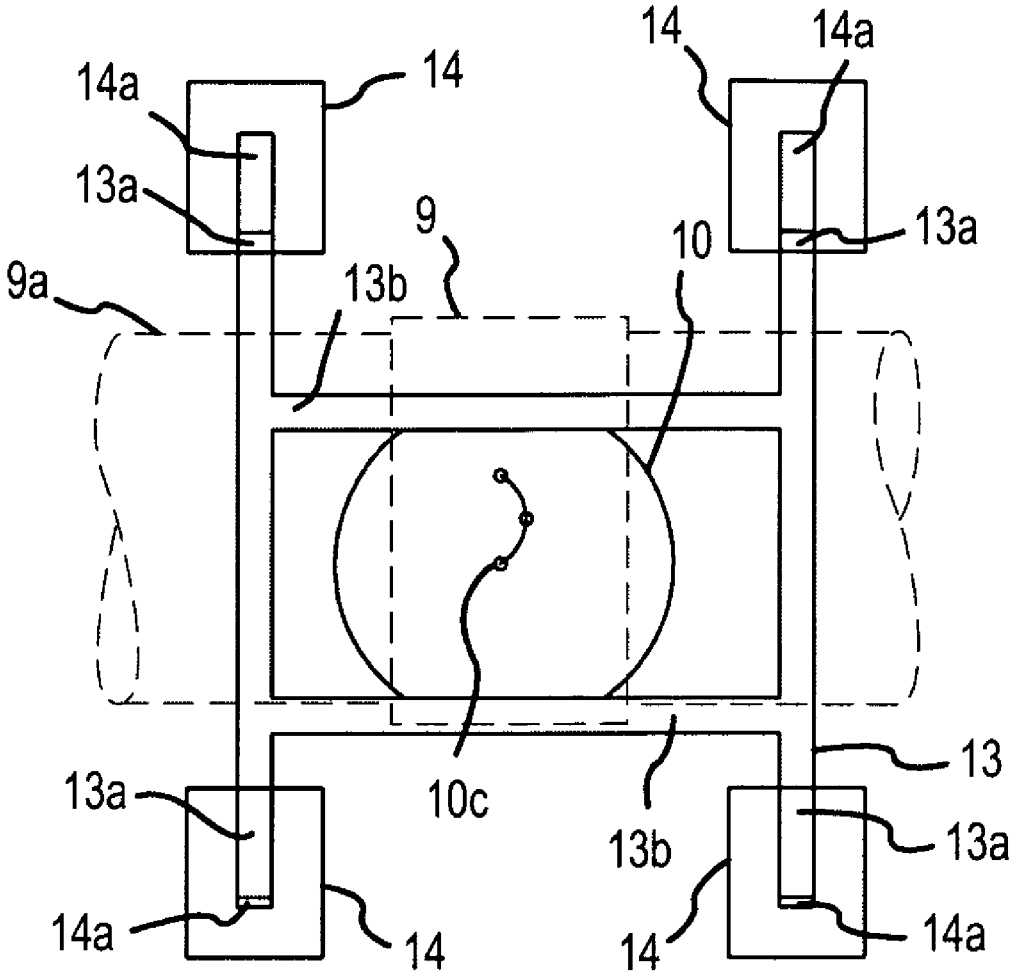
FIG. 3C shows the same view as FIG. 3B, but with the roller lifter moved near to the other extreme of travel.

FIG. 3C shows the same view as FIG. 3B, but with the roller lifter moved near to the other extreme of travel. Referring now to FIG. 3C, the eccentric sleeve (not shown) is rotated approximately a further 60° clockwise from the centered position shown in FIG. 3B. The movement of constraining mechanism 13 towards the bottom of the diagram is obvious. The position of the center of roller lifter 10 is shown as center 10*c*.

Figure 4:
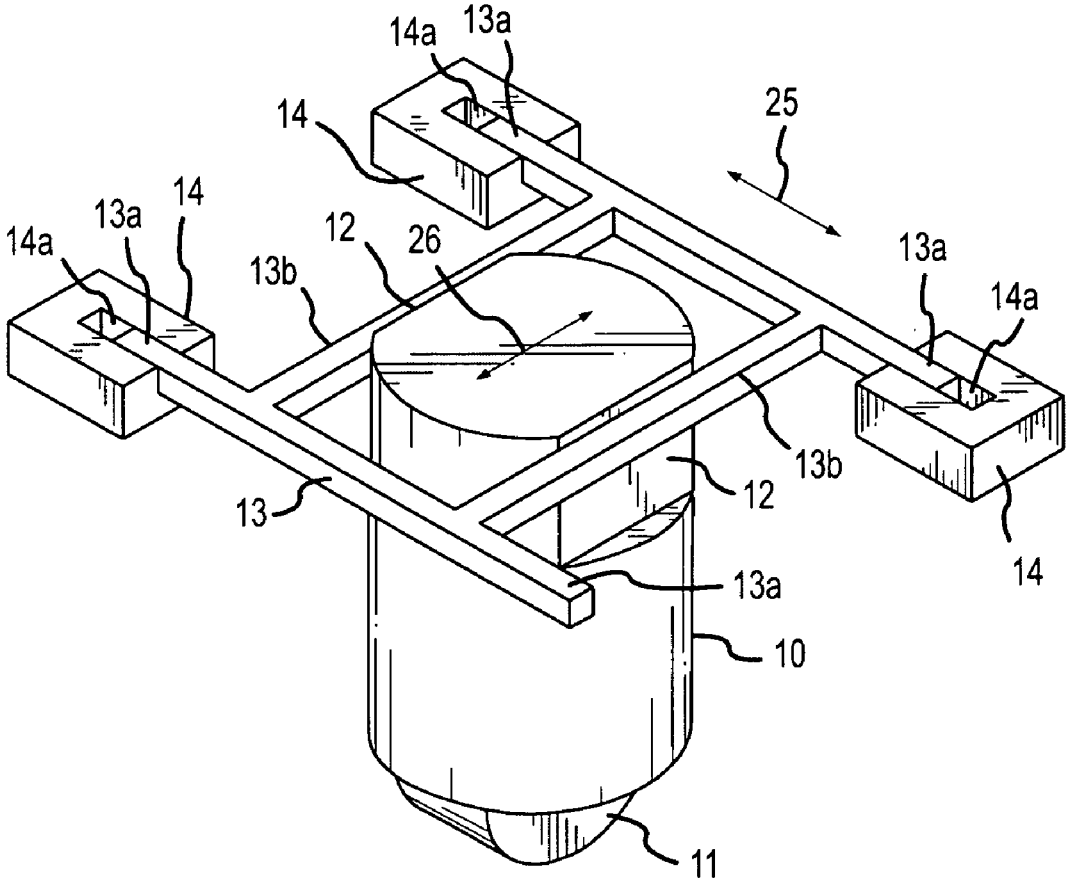
FIG. 4 shows an isometric view of a roller lifter and a two-sided yoke-like constraining mechanism with the location of the flat surfaces on the roller lifter located essentially perpendicular to their position in FIG. 2, where the direction of movement of the constraining mechanism is also substantially perpendicular.

FIG. 4 shows an isometric view of a roller lifter and a two-sided yoke-like constraining mechanism with the location of the flat surfaces on the roller lifter located essentially perpendicular to their position in FIG. 2, where the direction of movement of the constraining mechanism is also substantially perpendicular to that shown in FIG. 2. Referring now to FIG. 4, this embodiment of the invention shows that the direction of motion of the constraining mechanism 13, shown by arrow 25, is substantially perpendicular to the movement of the roller lifter 10, shown by arrow 26. Surfaces 12 on the roller lifter may be located at any orientation between those shown in FIG. 2 and FIG. 4 as long as interior members 13*b* that mate to flat surfaces 12 are substantially parallel to each other. As stated above, the directions of movement indicated by arrows 25 and 26 need not be substantially perpendicular to each other. As in FIG. 2, for simplicity one stationary block 14 is also omitted from this view. Only one stationary block 14 is necessary to provide a minimum amount of constraint for roller lifter 10.

Figure 5:
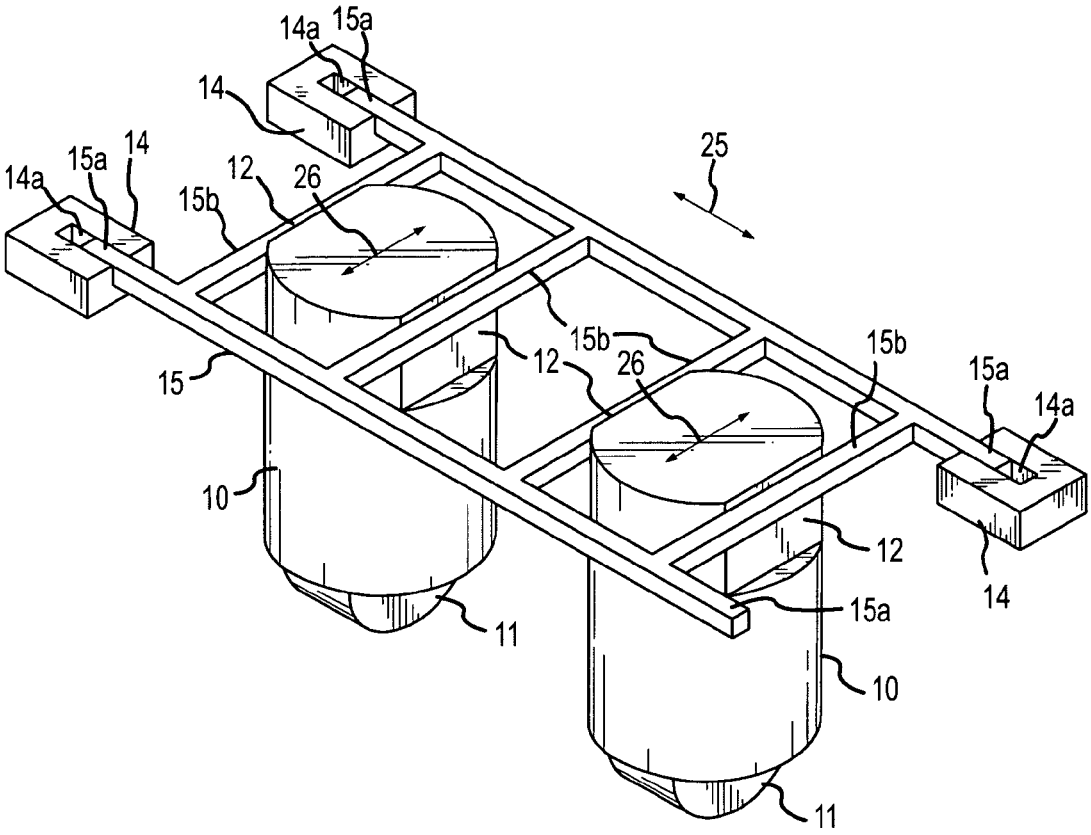
FIG. 5 shows an isometric view of multiple lifters with a common two-sided yoke-like constraining mechanism of the present invention.

FIG. 5 shows an isometric view of multiple lifters with a common two-sided constraining mechanism of the present invention. Referring now to FIG. 5, an isometric view of multiple lifters with a common two-sided constraining mechanism 15 ensuring controlled orientation of roller lifters 10 is shown. As with the change in orientation of the constraining mechanism 13 and parallel flat surfaces 12 in FIG. 4, these may be oriented substantially perpendicular to the directions shown without altering the operation of the orientation of the roller lifters 10. As in FIG. 2, only three stationary blocks 14 are shown, although adequate constraint, as discussed above, requires a minimum of one stationary block 14. End members 15*a* are engaged within slots 14*a* of stationary blocks 14, and each pair of interior members 15*b* each engage the parallel flat surfaces 12 of a roller lifter 10. One skilled in the art will recognize that additional pairs of interior members 15*b* may be added for each additional roller lifter 10 so aligned in the engine.

Figure 6:
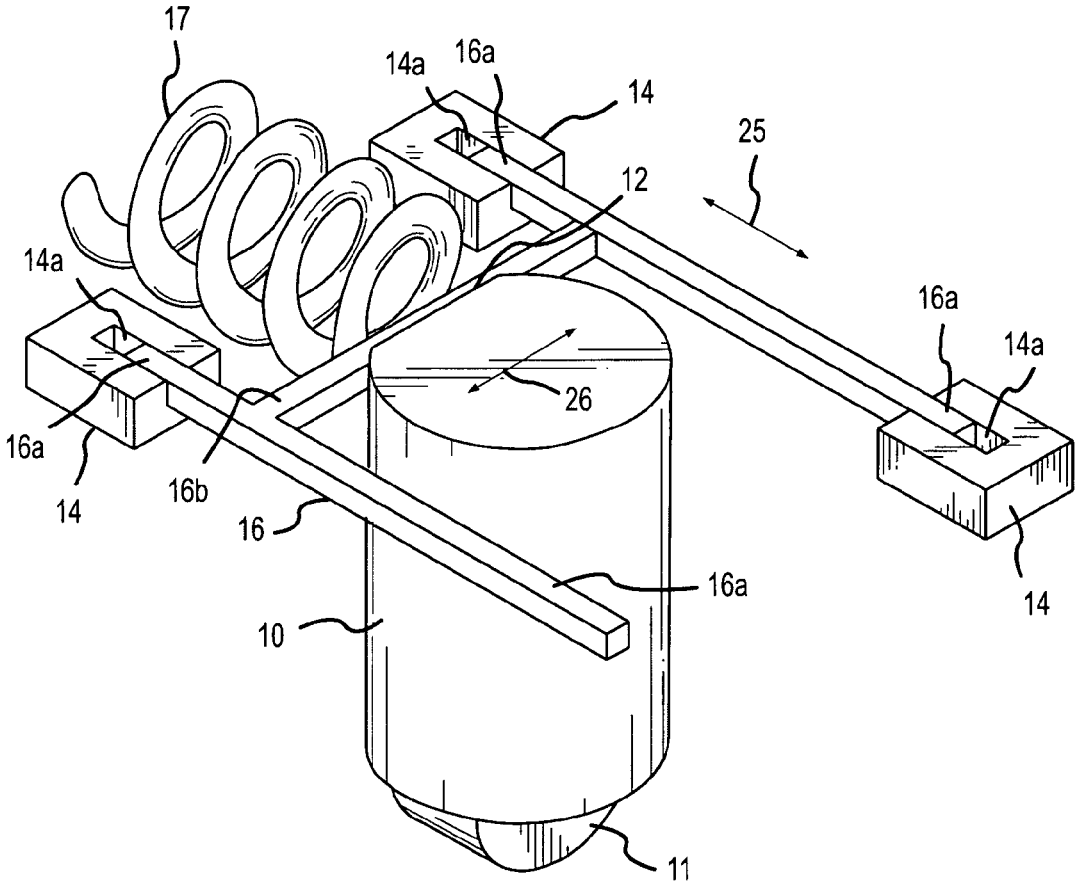
FIG. 6 shows an isometric view of a single roller lifter with a one-sided yoke-like constraining mechanism of the present invention.

FIG. 6 shows an isometric view of a single roller lifter with a one-sided yoke-like constraining mechanism of the present invention. Referring now to FIG. 6, an isometric view of a single roller lifter 10 with a one-sided constraining mechanism 16 is shown. Spring 17 pushes an interior member 16*b* of one-sided constraining mechanism 16 against a flat surface 12 of roller lifter 10 to ensure controlled orientation of roller lifter 10, constraining movement of roller lifter 10 in the directions represented by arrows 25 and 26, which, as stated above, need not be substantially perpendicular to each other. As in FIG. 2, for simplicity one stationary block 14 is also omitted from this view. Only one stationary block 14 is necessary to provide a minimum amount of constraint for roller lifter 10. End members 16*a* are engaged within slots 14*a* of stationary blocks 14. One skilled in the art will recognize that additional roller lifters 10 could be added along with additional interior members 16*b* similar to that shown in FIG. 5.

Figure 7:
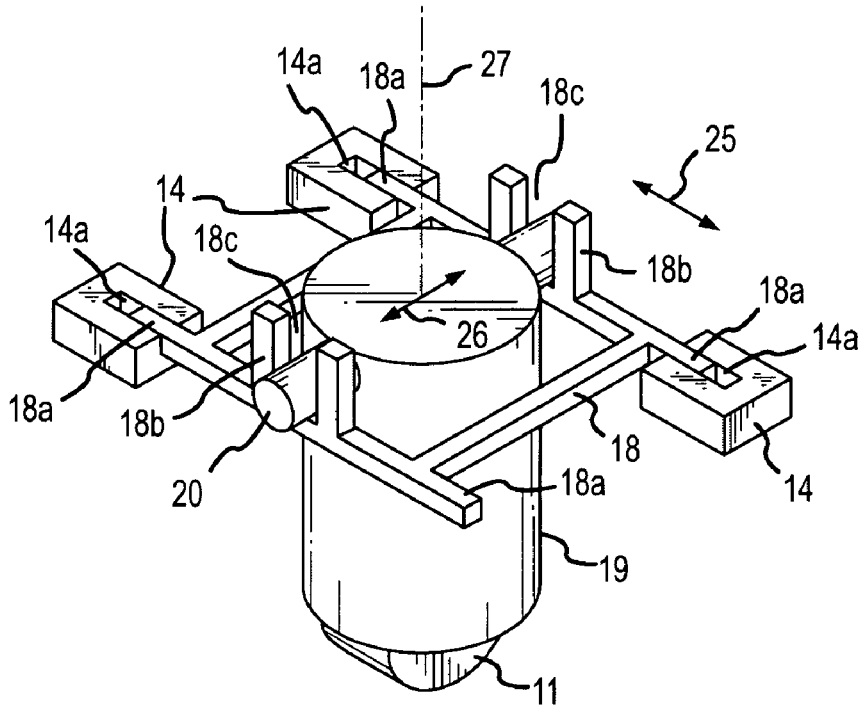
FIG. 7 shows an isometric view of a single roller lifter with locating pins and a two-sided, slotted yoke-like constraining mechanism of the present invention.

FIG. 7 shows an isometric view of a single roller lifter with locating pins and a two-sided, slotted yoke-like constraining mechanism of the present invention. Referring now to FIG. 7, an isometric view of a single roller lifter 19 with attached or integral locating pins 20 perpendicular to longitudinal axis 27 of single roller lifter 19 is shown. Two-sided, slotted constraining mechanism 18 has interior members 18*b*, each having a slot 18*c* which engage each locating pin 20. As single roller lifter 19 is moved through its arc, locating pins 20 slide in and out of slot 18*c* of interior members 18*b* of slotted constraining mechanism 18, in a direction indicated by arrow 26, while the end members 18*a* of slotted constraining mechanism 18 slide fore-and-aft in slots 14*a* of stationary blocks 14, substantially perpendicular to the direction of movement of single roller lifter 19 relative to slotted constraining mechanism 18, indicated by arrow 25. These two constraints maintain controlled orientation of single roller lifter 19 as it moves through its arcuate path.

Figure 8:
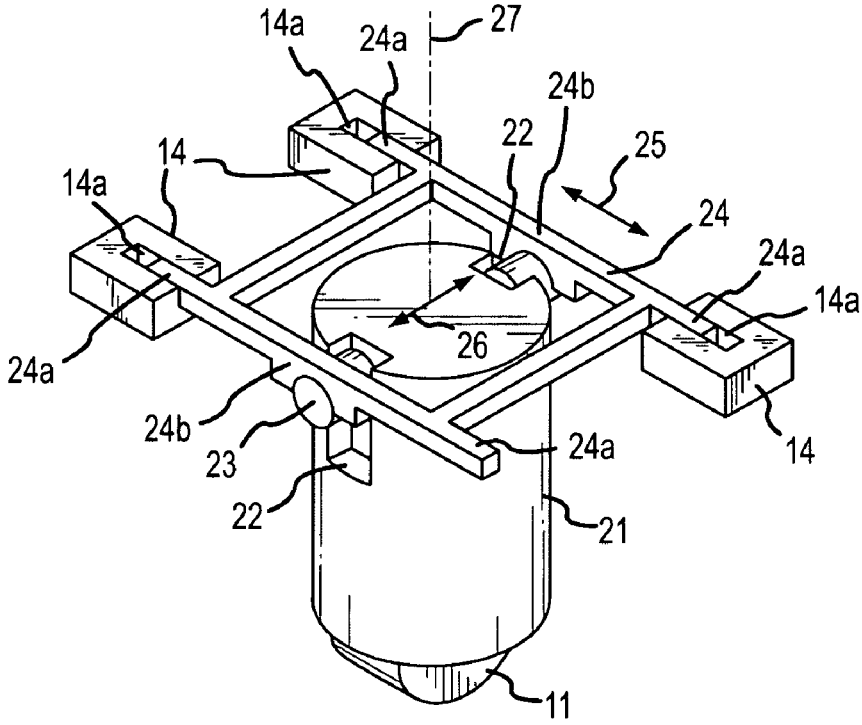
FIG. 8 shows an isometric view of a single roller lifter with grooves in the roller lifter for orientation and a yoke-like constraining mechanism with engaging pins of the present invention.

FIG. 8 shows an isometric view of a single roller lifter with grooves in the roller lifter for orientation and a yoke-like constraining mechanism with engaging pins of the present invention. Referring now to FIG. 8, an isometric view of a single roller lifter 21, with grooves 22 machined along its length parallel to its longitudinal axis 27 is shown. Engaging pins 23 attached or integral to interior members 24*b* of constraining mechanism 24 maintain controlled orientation of single roller lifter 21 as it moves through its arc. Single roller lifter 21 slides back and forth against engaging pins 23 on interior members 24*b* of constraining mechanism 24 in a direction indicated by arrow 26, while the end members 24*a* of constraining mechanism 24 slide fore-and-aft in slots 14*a* of stationary blocks 14, substantially perpendicular to the direction of movement of single roller lifter 21 relative to engaging pins 23 on constraining mechanism 24, indicated by arrow 25. These two constraints maintain controlled orientation of single roller lifter 21 as it moves through its arcuate path.

Figure 9:
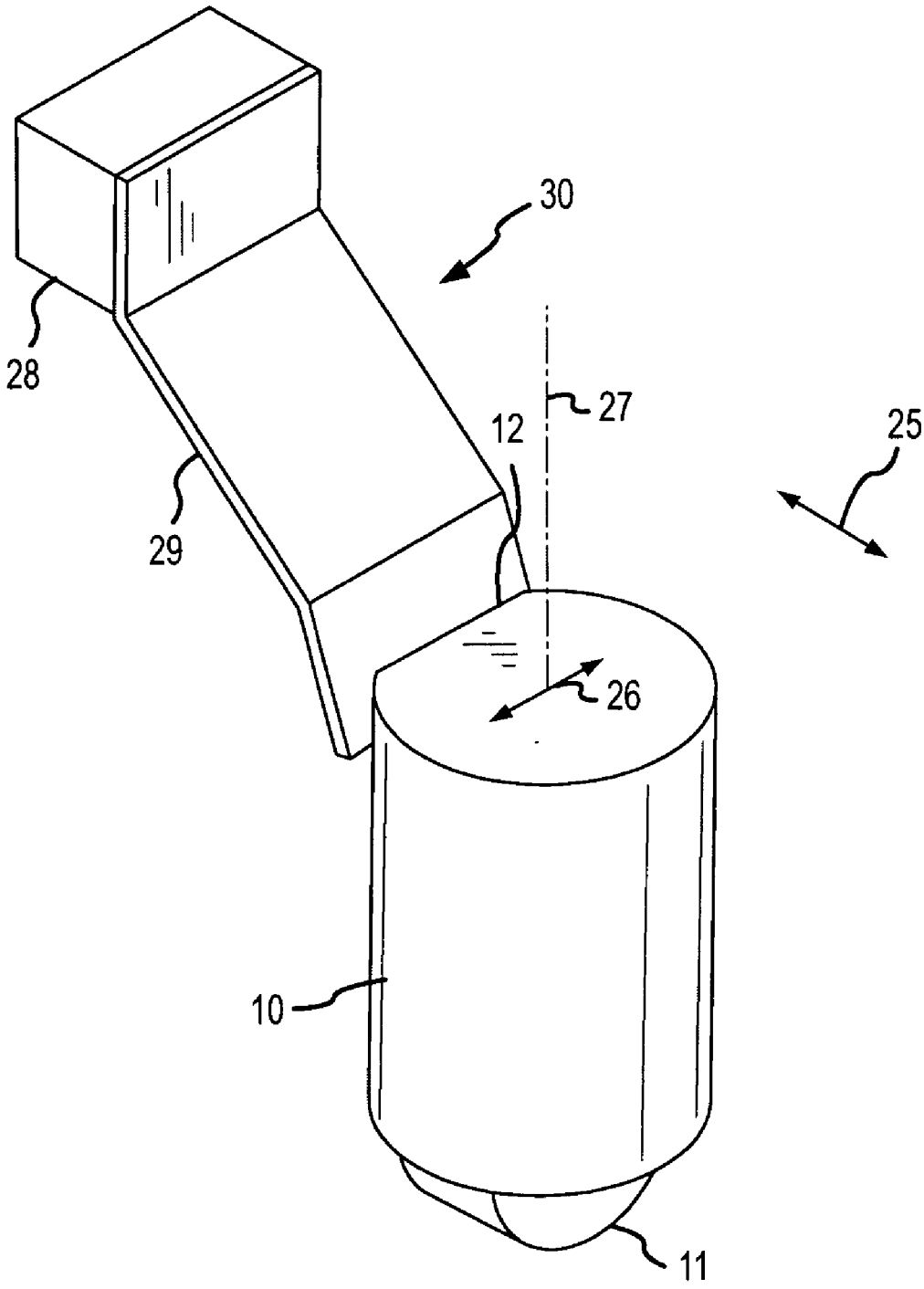
FIG. 9 shows an isometric view of an alternative single-sided biasing mechanism that does not require slidably engaging slots.

FIG. 9 shows an isometric view of a single roller lifter with a one-sided spring-like deformable constraining mechanism of the present invention. Referring now to FIG. 9, an isometric view of a single roller lifter 10 and roller 11 with a one-sided constraining mechanism 30 is shown. Base 28 is attached to the internal combustion engine. Deformable member 29 is attached to base 28 at one end, and the other end engages and pushes against a flat surface 12 of roller lifter 10 to ensure controlled orientation of roller lifter 10, constraining movement of roller lifter 10 in the directions represented by arrows 25 and 26. Roller lifter 10 is constrained to move in a direction coincident with the deflection of deformable member 29 (arrow 25), and in a direction substantially perpendicular thereto (arrow 26), sliding along the end of deformable member 29 in contact with flat surface 12. As stated above, the directions of movement indicated by arrows 25 and 26 need not be substantially perpendicular to each other.

Roller lifter 10 also moves axially up-and-down along its longitudinal axis 27 as it engages with the cam (not shown), but is prevented from rotating about longitudinal axis 27 due to the limitations on movement provided by constraining mechanism 30. One skilled in the art will recognize that additional roller lifters 10 could be added along with additional constraining mechanisms 30 similar to that shown in FIG. 5.

Having described the present invention, it will be understood by those skilled in the art that many changes in construction and widely differing embodiments and applications of the invention will suggest themselves without departing from the scope of the present invention.

What is claimed is:

1. An apparatus in an internal combustion engine having a rotatable element that eccentrically moves at least one roller lifter to alter the phasing of the at least one roller lifter engaging with a cam, the apparatus comprising:

a constraining mechanism having at least one end member and at least two interior members connected to said at least one end member; and at least one stationary block which slidably receives a one of said at least one end member allowing fore-and-aft movement of said constraining mechanism in cooperation with a first roller lifter in a first direction;

wherein said at least two interior members engage said first roller lifter to allow movement of said first roller lifter in a second direction to said first direction such that when the rotatable element eccentrically moves said first roller lifter, said first roller lifter is prevented from rotating about a longitudinal axis of said first roller lifter.

2. The apparatus according to claim 1 wherein said at least two interior members each engage a one of two flat surfaces of said first roller lifter to allow said movement in said second direction.

3. The apparatus according to claim 2 wherein said at least two interior members are substantially parallel to each other, and said two flat surfaces of said first roller lifter are substantially parallel to each other.

4. The apparatus according to claim 1 wherein said first direction and said second direction range from being substantially perpendicular to each other to an orientation not too close to parallel such that the at least one roller lifter becomes constrained from moving eccentrically while being prevented from rotating about said longitudinal axis.

5. The apparatus according to claim 1 further comprising:

a second roller lifter aligned with said first roller lifter; and an additional pair of interior members connected to said at least one end member, wherein said additional pair of interior members each engage a one of two flat surfaces of said second roller lifter to allow movement of said second roller lifter in said second direction, and said second roller lifter is prevented from rotating about a longitudinal axis of said second roller lifter.

6. The apparatus according to claim 5 wherein said additional pair of interior members are substantially parallel to each other, and said two flat surfaces of said second roller lifter are substantially parallel to each other.

7. The apparatus according to claim 1 wherein said at least two interior members each have a slot, and further wherein said first roller lifter has two locating pins extending from opposite sides of said first roller lifter and perpendicular to said longitudinal axis of said first roller lifter, wherein each of said two locating pins engages with a one of said slots of said at least two interior members to allow said movement of said first roller lifter in said second direction.

8. The apparatus according to claim 1 wherein each of said at least two interior members have an engaging pin, and further wherein said first roller lifter has a first groove and a second groove located on opposite sides of said first roller lifter from each other and parallel to said longitudinal axis of said first roller lifter, wherein one of said engaging pins of said at least two interior members engages with said first groove and an other of said engaging pins of said at least two interior members engages with said second groove in said first roller lifter to allow said movement of said first roller lifter in said second direction.

9. An apparatus in an internal combustion engine having a rotatable element that eccentrically moves at least one roller lifter to alter the phasing of the at least one roller lifter engaging with a cam, the apparatus comprising:

a constraining mechanism having at least one end member and at least one interior member connected to said at least one end member;

at least one stationary block which slidably receives a one of said at least one end member allowing fore-and-aft movement of said constraining mechanism in cooperation with a first roller lifter in a first direction; and a spring biased against said at least one interior member;

wherein said spring and said at least one interior member engage said first roller lifter to allow movement in a second direction to said first direction such that when the rotatable element eccentrically moves said first roller lifter, said first roller lifter is prevented from rotating about a longitudinal axis of said first roller lifter.

10. The apparatus according to claim 9 wherein said at least one interior member engages at least one flat surface of said first roller lifter to allow movement in said second direction.

11. The apparatus according to claim 9 wherein said first direction and said second direction range from being substantially perpendicular to each other to an orientation not too close to parallel such that the at least one roller lifter becomes constrained from moving eccentrically while being prevented from rotating about said longitudinal axis.

12. The apparatus according to claim 9 further comprising:

a second roller lifter aligned with said first roller lifter; and an additional interior member connected to said at least one end member, wherein said additional interior member engages a flat surface of said second roller lifter to allow movement in said second direction, and said second roller lifter is prevented from rotating about a longitudinal axis of said second roller lifter.

13. A method for controlling the orientation of at least one roller lifter in an internal combustion engine having a rotatable element that eccentrically moves the at least one roller lifter to alter the phasing of the at least one roller lifter engaging with a cam, the method comprising:

(a) slidably receiving a constraining mechanism in at least one stationary block, wherein said constraining mechanism in cooperation with a first roller lifter is only allowed to move fore-and-aft in a first direction;

(b) engaging at least two interior members of said constraining mechanism with said first roller lifter, wherein said first roller lifter is allowed to move in cooperation with said constraining mechanism in a second direction to said first direction;

(c) eccentrically moving in said first and second directions said first roller lifter with the rotatable element engaged with said first roller lifter; and (d) preventing said first roller lifter from rotating about a longitudinal axis of said first roller lifter through the cooperation of said first roller lifter with said constraining mechanism.

14. A method according to claim 13 wherein step (a) further comprises:

slidably receiving a first end member of said constraining mechanism in a first of said at least one stationary blocks; and slidably receiving a second end member of said constraining mechanism in a second of said at least one stationary blocks.

15. A method according to claim 13 wherein step (b) further comprises:

engaging a first of said at least two interior members of said constraining mechanism with a first flat surface of said first roller lifter; and engaging a second of said at least two interior members of said constraining mechanism with a second flat surface of said first roller lifter;

wherein said first flat surface and said second flat surface are substantially parallel to each other.

16. A method according to claim 13 wherein said first direction and said second direction range from being substantially perpendicular to each other to an orientation not too close to parallel such that the at least one roller lifter becomes constrained from moving eccentrically while being prevented from rotating about said longitudinal axis.

17. A method according to claim 13 further comprising:

engaging at least two additional interior members of said constraining mechanism with a second roller lifter aligned with said first roller lifter, wherein said second roller lifter is allowed to move in said second direction;

eccentrically moving in said first and second directions said second roller lifter with the rotatable element engaged with said second roller lifter; and preventing said second roller lifter from rotating about a longitudinal axis of said second roller lifter through the cooperation of said second roller lifter with said at least two additional interior members of said constraining mechanism.

18. A method according to claim 13 wherein step (b) further comprises:

engaging a slot within a first of said at least two interior members of said constraining mechanism with a first locating pin on said first roller lifter; and engaging a slot within a second of said at least two interior members of said constraining mechanism with a second locating pin on said first roller lifter;

wherein said first locating pin and said second locating pin extend from opposite sides of said first roller lifter.

19. A method according to claim 13 wherein step (b) further comprises:

engaging an engaging pin within a first of said at least two interior members of said constraining mechanism with a first groove on said first roller lifter; and engaging an engaging pin within a second of said at least two interior members of said constraining mechanism with a second groove on said first roller lifter;

wherein said first groove and said second groove are located on opposite sides of said first roller lifter and parallel to said longitudinal axis of said first roller lifter.

20. A method for controlling the orientation of at least one roller lifter in an internal combustion engine having a rotatable element that eccentrically moves the at least one roller lifter to alter the phasing of the at least one roller lifter engaging with a cam, the method comprising:

(a) slidably receiving a constraining mechanism in at least one stationary block, wherein said constraining mechanism in cooperation with a first roller lifter is only allowed to move fore-and-aft in a first direction;

(b) engaging at least one interior member of said constraining mechanism with said first roller lifter;

(c) biasing a spring against said at least one interior member, wherein said first roller lifter is allowed to move in cooperation with said constraining mechanism in a second direction to said first direction;

(d) eccentrically moving in said first and second direction said first roller lifter with a rotatable element engaged with said first roller lifter; and (e) preventing said first roller lifter from rotating about a longitudinal axis of said first roller lifter through the cooperation of said first roller lifter with said constraining mechanism.

21. A method according to claim 20 wherein step (a) further comprises:

slidably receiving a first end member of said constraining mechanism in a first of said at least one stationary blocks; and slidably receiving a second end member of said constraining mechanism in a second of said at least one stationary blocks.

22. A method according to claim 20 wherein step (b) further comprises:

engaging said at least one interior member of said constraining mechanism with a flat surface of said first roller lifter.

23. A method according to claim 20 wherein said first direction and said second direction range from being substantially perpendicular to each other to an orientation not too close to parallel such that the at least one roller lifter becomes constrained from moving eccentrically while being prevented from rotating about said longitudinal axis.

24. A method according to claim 20 further comprising:

engaging at least one additional interior member of said constraining mechanism with a second roller lifter aligned with said first roller lifter, wherein said second roller lifter is allowed to move in said second direction;

eccentrically moving in said first and second directions said second roller lifter with the rotatable element engaged with said second roller lifter; and preventing said second roller lifter from rotating about a longitudinal axis of said second roller lifter through the cooperation of said second roller lifter with said at least one additional interior member of said constraining mechanism.

25. An apparatus in an internal combustion engine having a rotatable element that eccentrically moves at least one roller lifter to alter the phasing of the at least one roller lifter engaging with a cam, the apparatus comprising:

a first constraining mechanism having a deformable member, said deformable member further comprising:

a first end which pushes against a flat surface of a first roller lifter;

wherein said constraining mechanism allows fore-and-aft movement of said first roller lifter in a first direction coincident with the deflection of said deformable member, and allows movement of said first roller lifter in a second direction to said first direction such that when the rotatable element eccentrically moves said first roller lifter, said first roller lifter is prevented from rotating about a longitudinal axis of said first roller lifter.

26. The apparatus according to claim 25 wherein said first constraining mechanism further comprises:

a base; and a second end of said deformable member attached to said base;

wherein said base is attached to the internal combustion engine.

27. The apparatus according to claim 25 wherein said first direction and said second direction range from being substantially perpendicular to each other to an orientation not too close to parallel such that the at least one roller lifter becomes constrained from moving eccentrically while being prevented from rotating about said longitudinal axis.

28. The apparatus according to claim 25 further comprising:

a second roller lifter aligned with said first roller lifter; and a second constraining mechanism having a deformable member having a first end which pushes against a flat surface of said second roller lifter;

wherein said second constraining mechanism allows fore-and-aft movement of said second roller lifter in said first direction coincident with the deflection of said deformable member, and allows movement of said second roller lifter in said second direction such that when the rotatable element eccentrically moves said second roller lifter, said second roller lifter is prevented from rotating about a longitudinal axis of said second roller lifter.

29. The apparatus according to claim 28 wherein said second constraining mechanism further comprises:

a base; and a second end of said deformable member attached to said base;

wherein said base is attached to the internal combustion engine.

30. A method for controlling the orientation of at least one roller lifter in an internal combustion engine having a rotatable element that eccentrically moves the at least one roller lifter to alter the phasing of the at least one roller lifter engaging with a cam, the method comprising:

(a) attaching a first constraining mechanism to the internal combustion engine;

(b) engaging a first end of a deformable member of said first constraining mechanism with a flat surface of a first roller lifter, wherein said first roller lifter, in cooperation with said first constraining mechanism is allowed to move fore-and-aft in a first direction coincident with the deflection of said deformable member, and is allowed to move in a second direction to said first direction;

(c) eccentrically moving in said first and second directions said first roller lifter with the rotatable element engaged with said first roller lifter; and (d) preventing said first roller lifter from rotating about a longitudinal axis of said first roller lifter through the cooperation of said first roller lifter with said first constraining mechanism.

31. A method according to claim 30 wherein step (a) further comprises:

attaching a base of said first constraining mechanism to the internal combustion engine; and attaching a second end of said deformable member of said first constraining mechanism to said base.

32. A method according to claim 30 wherein said first direction and said second direction range from being substantially perpendicular to each other to an orientation not too close to parallel such that the at least one roller lifter becomes constrained from moving eccentrically while being prevented from rotating about said longitudinal axis.

33. A method according to claim 30 further comprising the steps of:

(e) repeating steps (a) through (d) for a second constraining mechanism having a first end of a deformable member engaged with a flat surface of a second roller lifter.

34. A method according to claim 33 further comprising:

attaching a base of said second constraining mechanism to the internal combustion engine; and attaching a second end of said deformable member of said second constraining mechanism to said base.

* * * * *